US005937753A

United States Patent [19]

McKeever

[11] Patent Number: 5,937,753

[45] Date of Patent: Aug. 17, 1999

[54] METHOD AND APPARATUS FOR STRETCHING A SCREEN ON A SCREEN PRINTING ROLLER FRAME

[75] Inventor: Thomas A. McKeever, Maple Shade, N.J.

[73] Assignee: Stretch Devices, Inc., Philadelphia, Pa.

[21] Appl. No.: 09/024,847

[22] Filed: Feb. 17, 1998

[51] Int. Cl.[6] ..... B41F 15/02

[52] U.S. Cl. ..... 101/127.1; 38/102.21

[58] Field of Search ..... 101/127.1, 128, 101/128.1, 128.4, 129; 38/102, 102.1, 102.3, 102.91, 102.21; 269/115, 116, 117

[56] References Cited

U.S. PATENT DOCUMENTS

| | | | |
|---|---|---|---|
| 2,608,750 | 9/1952 | Cluzel | 101/127.1 |
| 3,601,912 | 8/1971 | Dubbs | 38/102.91 |
| 3,910,185 | 10/1975 | Brasa | 101/124 |
| 4,462,174 | 7/1984 | Messerschmitt | 38/102.1 |
| 4,525,909 | 7/1985 | Newman | 29/121.1 |
| 4,571,864 | 2/1986 | Bopp | 38/102.5 |
| 4,995,178 | 2/1991 | Randolph | 38/102 |
| 5,063,842 | 11/1991 | Clarke | 101/127.1 |
| 5,113,611 | 5/1992 | Rosson | 38/102.7 |
| 5,127,176 | 7/1992 | Newman | 38/102.1 |
| 5,129,171 | 7/1992 | Arbter et al. | 38/102.2 |
| 5,148,745 | 9/1992 | Hamu | 101/102.1 |
| 5,235,908 | 8/1993 | Froelicher et al. | 101/127.1 |
| 5,390,596 | 2/1995 | Farr | 101/129 |
| 5,488,901 | 2/1996 | Hruska | 101/129 |
| 5,676,052 | 10/1997 | Wegrzyn et al. | 101/127.1 |

FOREIGN PATENT DOCUMENTS

| | | |
|---|---|---|
| 2 028 721 | 8/1978 | United Kingdom . |
| 96/20087 | 7/1996 | WIPO . |

OTHER PUBLICATIONS

"Newman Roller Master™", Stretch Devices, Inc. advertisement (Model PB1).

"Newman Roller Master™", Stretch Devices, Inc. advertisement (Model C–3).

*Primary Examiner*—Ren Yan

*Attorney, Agent, or Firm*—Seidel, Gonda, Lavorgna & Monaco, PC

[57] ABSTRACT

A device is provided for stretching a screen secured to a screen printing roller frame. A series of wrenching stations are provided on a fixed work area. The wrenching stations include a wrench member shaped and dimensioned to mate with the end portions of the roller frame rollers so that the wrench may cause rotation of the roller. A first and second wrenching station are positioned adjacent one another at one corner of the work area and are fixed in position. A third wrenching station is positioned opposite the first wrenching station for rotating the opposing parallel roller in the roller frame at the same end as the first wrenching station. A fourth wrenching station is provided in an opposing relationship with the second wrenching station similar to the relationship between the first and third wrenching station. Actuation of the wrenching stations rotates and torques the respective rollers, stretching the screen on the roller frame. Preferably, the wrench members include an arcuate surface which defines an application area for applying a constant force to the rotate the rollers.

15 Claims, 8 Drawing Sheets

METHOD AND APPARATUS FOR STRETCHING A SCREEN ON A SCREEN PRINTING ROLLER FRAME

FIELD OF THE INVENTION

The present invention relates to a device for use within screen printing type operation. In particular, the invention relates to a device for rapidly and evenly tensioning a screen on a roller frame to be used in screen printing.

BACKGROUND OF THE INVENTION

The art of screen printing utilizes a tensioned screen or mesh mounted on a frame having a stenciled image thereon. Ink is applied through the screen in the areas where the stencil has not blocked the openings between the threads of the mesh. The screen is typically fixed onto a rectangular (sometimes square) frame. The present invention particularly relates to a roller frame which includes a plurality of rollers coupled together by corners. The corner members support the rollers for rotation about their longitudinal axes. Each roller includes a longitudinally extending channel or other screen securing means on its periphery so as to retain an edge portion of the screen during tensioning. The rollers are locked to the corner members at a rotated position so that the desired tension is maintained within the screen.

The typical screen printing roller frame includes a series of extruded hollow aluminum tubes. An end plug is secured or welded onto the end of the tube. The end plug is typically integrally formed with a nut-like structure which forms the rotation means for the roller. The corner of the frame is attached to the roller, outside of the end plug and its corresponding rotational nut.

The manual method of stretching a screen on a roller frame uses a wrench or the like which is applied to the nut-like portion of the end plug. As the wrench rotates the roller, the screen is tensioned. A bolt threaded into the end of the roller is used to secure the roller to the corner member at the desired rotated position, thus fixing the tension in the screen.

U.S. Pat. No. 5,488,901 to Jerome J. Hruska, which is herein incorporated by reference, shows a device for substantially automatically stretching a screen on a roller frame. The device includes a series of torsion stations located at each corner of the frame. Each torsion station includes a torsion tool which is attached to a shaft structure at a first pivot point. Each torsion station also has a support to which the shaft structure is attached at a second pivot point. The length of each shaft between the first and second pivot points is variable for the purpose of rotating the respective torsion tools and corresponding roller on the frame. A wrench head included in the torsion tool engages one end of each roller. Each of the shafts include a pneumatically powered cylinder positioned between the first and second pivot points. The pneumatic cylinders vary the length of the shaft, thereby causing the torsion tool to rotate and torque the attached roller. The present invention relates to an improvement to the device shown in Hruska U.S. Pat. No. 5,488,901.

BRIEF DESCRIPTION OF THE INVENTION

The present invention relates to a device for stretching a screen on a roller frame. The device includes a series of wrenching stations. Each wrenching station is located at a corner of a work area adapted to support the roller frame. The wrenching stations include a wrench member shaped and dimensioned to mate with the end portion of the roller so that the wrench may cause rotation of the roller within the frame. A first and second wrenching station are positioned adjacent one another at one corner of the work area and thus one corner of the roller frame. Each is positioned to cause rotation of one of the rollers attached to the corner of the frame. A third wrenching station is positioned opposite the first wrenching station and for causing rotation of the opposing parallel roller in the roller frame. The first and third wrenching stations rotate the opposing rollers at the same relative ends thereof. If a fourth wrenching station is provided, it is positioned opposite of the second station and is adapted to rotate the opposing roller at the same relative end as the second station. Also provided is means for actuating the wrench members so as to rotate and torque the respective rollers, stretching the screen on the roller frame.

The third and fourth wrenching stations may be movable relative to the first and second wrenching stations which are fixed at a corner work area. A series of support pads may be provided at the corners of the frame to position the frame on the work area. The pad adjacent the first and second wrenching stations is preferably fixed. The pads adjacent the third and fourth wrenching stations may be movable so as to adjust to the size of the frame.

The preferred wrench member of the present invention comprises a roller engaging surface which engages the end of the roller for applying a rotational force thereto. Each wrench member may also include an arcuate surface which forms a circular arc having an axis substantially coincidental with the longitudinal axis of the roller when the roller is engaged for rotation. A cable is connected at one end to the wrenching member. The opposite end of the cable is attached to the actuation means. The cable extends, around the arcuate surface of the wrench member. As the actuating means causes tension in the cable, a constant tangential force is created to rotate and torque the roller.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
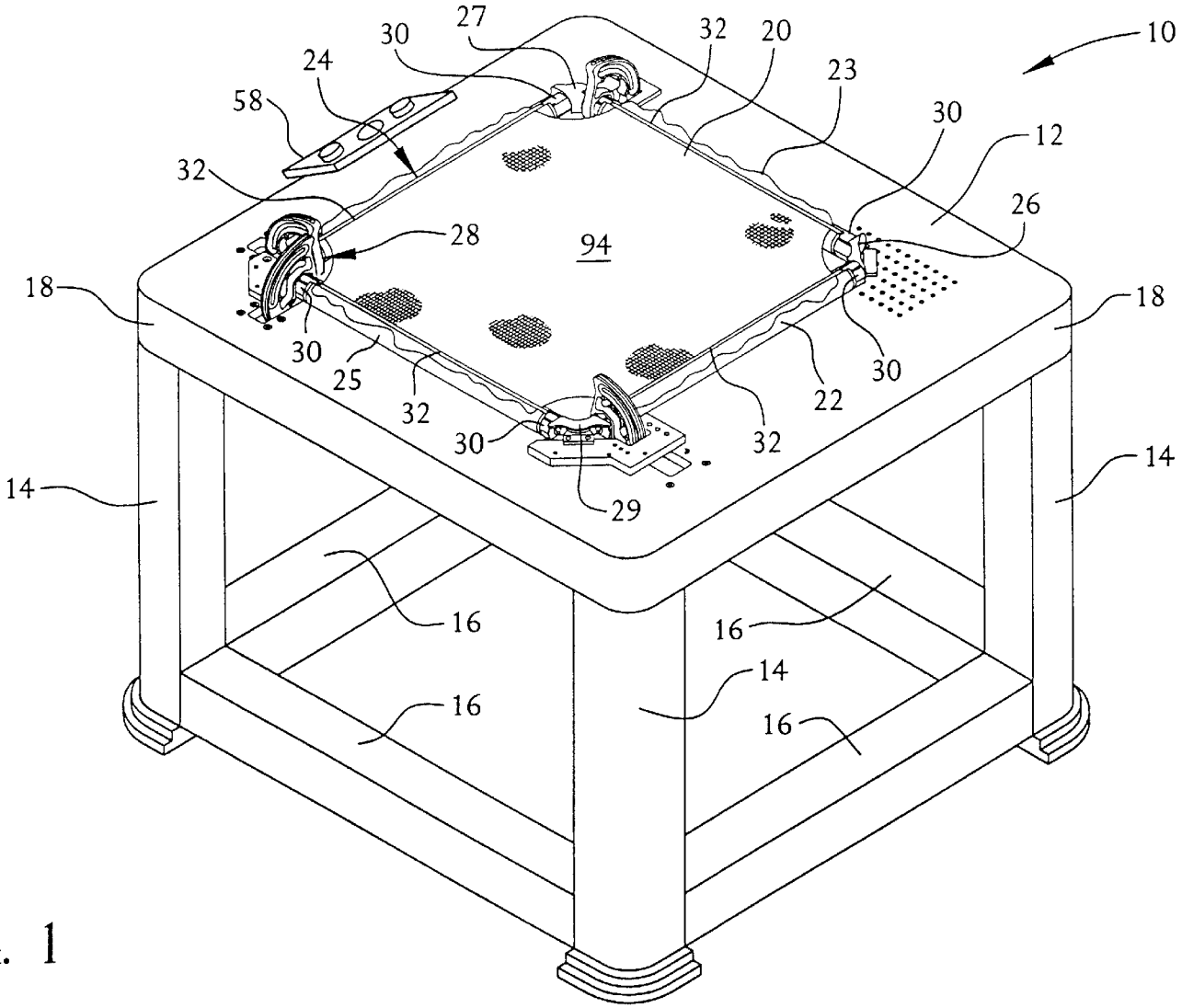
FIG. 1 is a perspective view of a device for stretching a screen secured to a screen printing roller frame as contemplated by the present invention.

In the drawings, where like numerals identify like elements, there is shown various embodiments of a device for stretching a screen secured to a roller frame. As shown in FIG. 1, the device generally includes a table which is designated by the numeral 10. The table 10 includes a deck or top plate 12 supported by a series of legs 14. In order to maintain the table 10 as stable as possible, a series of cross members 16 are provided at the base of the legs 14. An upper support rim 18 is provided at the top of the legs 14. The rim 18 wraps around and supports the periphery of the deck 12.

Positioned on the deck 12 is a roller frame 20. As illustrated, the roller frame 20 includes four individual rollers 22–25 which are attached at each respective end to corner members 26–29. Each end of the rollers 22–25 includes a nut-like element 30 which serves as an end plug for the extruded hollow cylindrical tubes which form the rollers. A locking groove 32 is provided in each of the rollers. The locking groove may be made in accordance with U.S. Pat. No. 4,525,909. The end plugs may be made in accordance with U.S. Pat. No. 5,127,176. These two patents are herein incorporated by reference.

Figure 2:
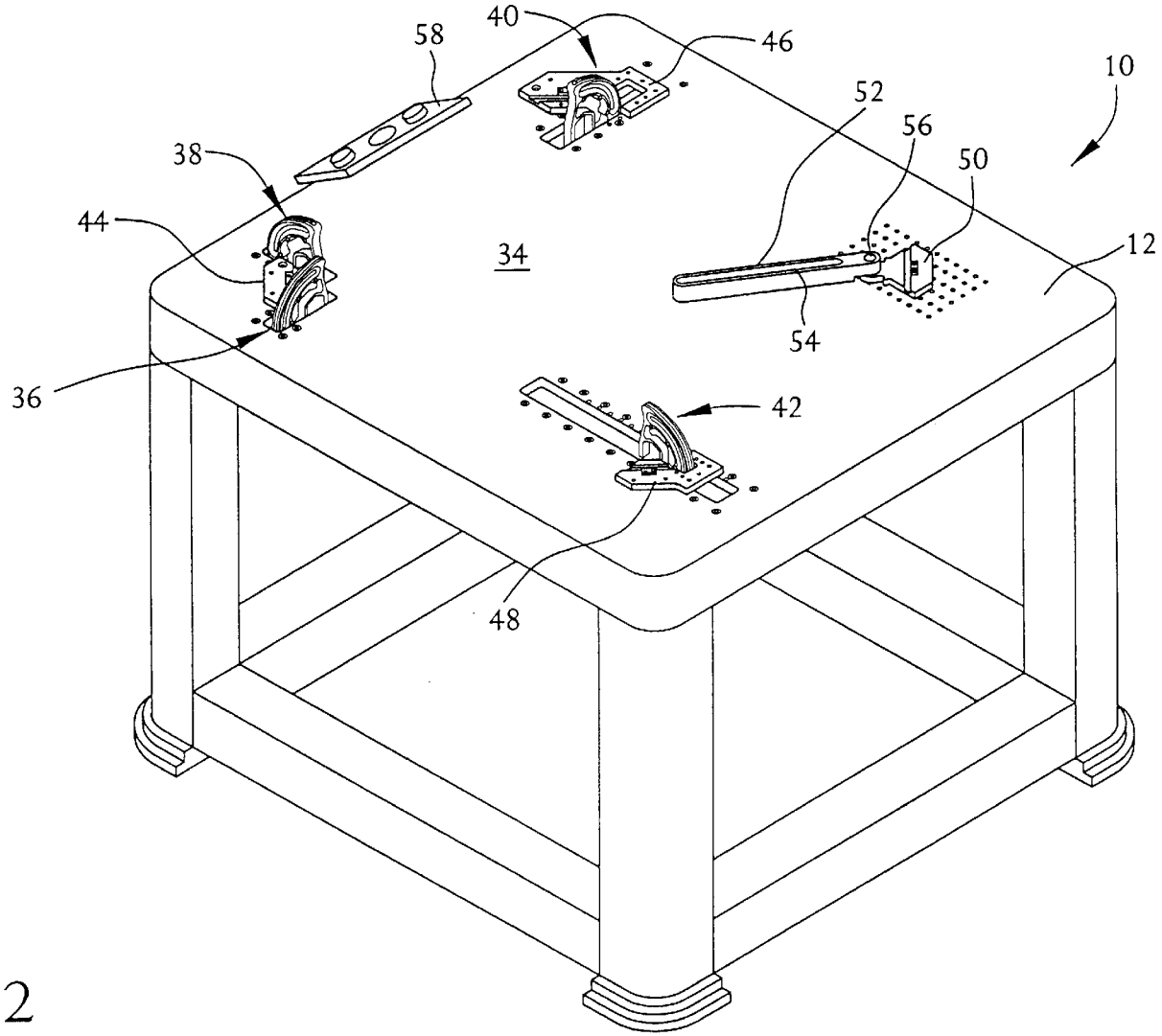
FIG. 2 is a perspective view the device shown in FIG. 1 with the roller frame removed from the work area.

As more particularly illustrated in FIG. 2, the table 10 includes a work area 34 which is a portion of the deck 12. The work area is generally defined by a series of wrenching stations 36, 38, 40 and 42. The first wrenching station 36 is positioned at one corner of the roller frame (FIG. 1). The second wrenching station 38 is adapted to engage a roller attached to the same corner of the frame as the separate roller engaged by the first wrenching station 36. The third wrenching station 40 engages a roller in the frame which is parallel to the roller engaged by the first wrenching station 36. Also, the first wrenching station 36 and the third wrenching station 40 are positioned at the same relative ends of the opposing rollers. Similarly, the second wrenching station is positioned to oppose the fourth wrenching station 42 and at the same relative end of the roller as the opposing roller engaged by the fourth wrenching station 42.

A series of pads are provided at the corners of the frame to support the frame on the work area 34. A fixed pad 44 is positioned at the corner of the frame adjacent to the first wrenching station 36 and second wrenching station 38. A movable pad 46 is positioned adjacent to and forms a part of the third wrenching station 40. Another movable pad 48 is provided at the corner adjacent to the fourth wrenching station 42. Finally, a sliding pad 50 is provided at the open corner of the work area 34. The sliding pad 50 is attached to a swing arm 52 which is secured at one end to the deck 12 by a shoulder bolt 64 or similar device. A slot 54 is provided within the swing arm 52. The sliding pad 50 is pivotably mounted at one end of the swing arm 52 by means of a lap joint 56. A control panel 58 is provided at one end of the table 10. The actuation of the wrenching stations 36, 38, 40 and 42 is controlled by elements positioned on the panel 58.

Figure 3:
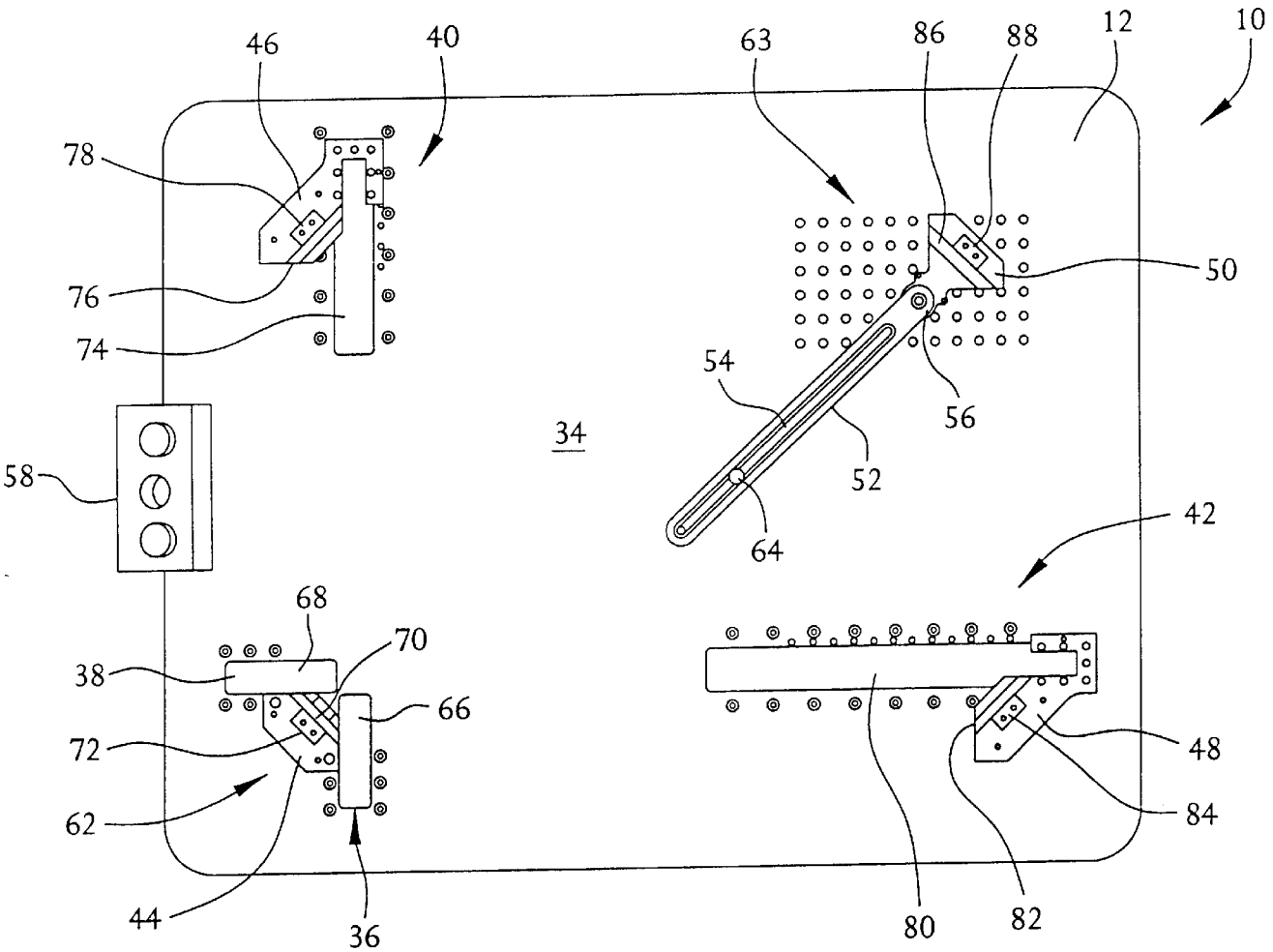
FIG. 3 is a top plan view of the work area of the screen stretching device.

As is more particularly illustrated in FIG. 3, the work area 34 on the deck 12 is defined in part by fixed corner 62 which encompasses the first and second wrenching stations 36 and 38. Openings are provided in deck 12 for positioning of these two wrenching stations. Opening 66 is provided for the wrench member (not shown in FIG. 3) which forms a part of the first wrenching station 36. A second opening 68 is provided for the wrench member (not shown in FIG. 3) for the second wrenching station 38. The two openings 66 and 68 at the fixed corner 62 are positioned substantially perpendicular to one another, with the fixed pad 44 positioned therebetween. The fixed pad 44 includes a groove 70 therein which accommodates a corner member of the frame (shown in FIG. 1). A lateral support plate 72 is provided on the outside edge of the groove 70 and is fixed to the pad 44.

An elongated opening 74 is provided in the deck 12 opposite opening 36. Movable pad 46 is positioned adjacent opening 74. A groove 76 is provided in the movable pad 46 and is adapted to receive a corner of the frame. A lateral support plate 78 is fixed to the pad 46 adjacent groove 76. The second movable pad 48 is positioned adjacent opening 80 which is on the opposite side of the work area 34 from opening 38. Movable pad 48 is substantially a mirror image of pad 46. Opening 80 is elongated so as to permit movement of the fourth wrenching station 42 relative to the fixed corner 62. Movable pad 48 includes a groove 82 and a lateral support plate 84. The fourth wrenching station 42 is positioned within the opening 80 and cooperates with the movable pad 48. Similarly, movable pad 46 forms a part of the third wrenching station 40.

The fourth corner 63 of the work area 34 is defined by the sliding pad 50. The sliding pad 50 includes a groove 86 and a lateral support plate 88 for fixing the corner of the frame. Sliding pad 50 is rotatably secured to the swing arm 52 at the lap joint 56. The swing arm 52 may be rotated around the shoulder bolt 64 which is secured to the deck 12. Sliding pad 50 may be moved inwardly to shorten the work area 34 by means of the shoulder bolt 64 positioned within slot 54 within the swing arm 52. The sliding pad 50 and movable pads 46 and 48, permit adjustment of the size of the work area 34 to accommodate different size roller frames.

Figure 6:
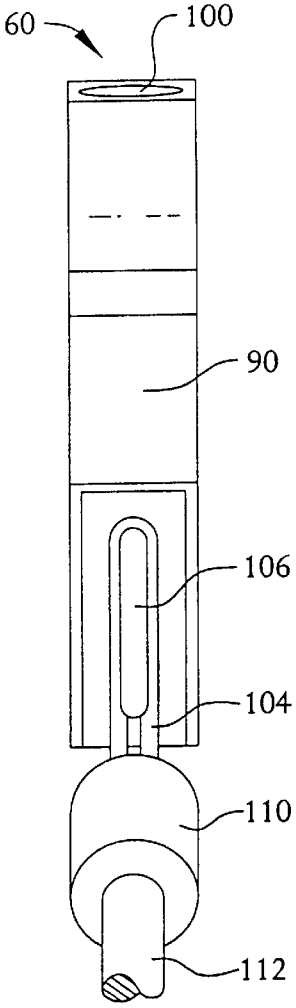
FIG. 6 is a bottom view of the wrench member as seen along line 6—6 in FIG. 4.
Figure 5:
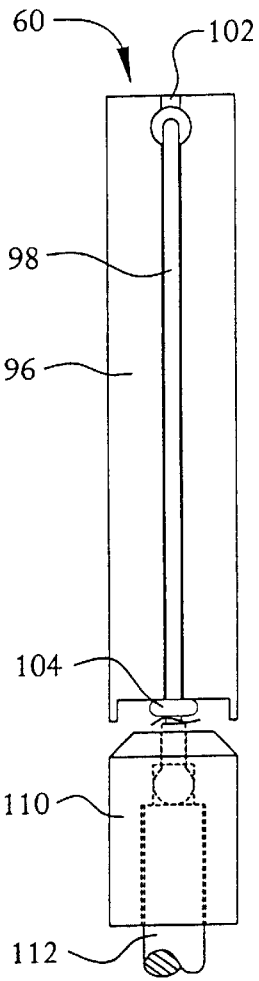
FIG. 5 is a rear side elevation of the wrench member as shown in FIG. 4.
Figure 4:
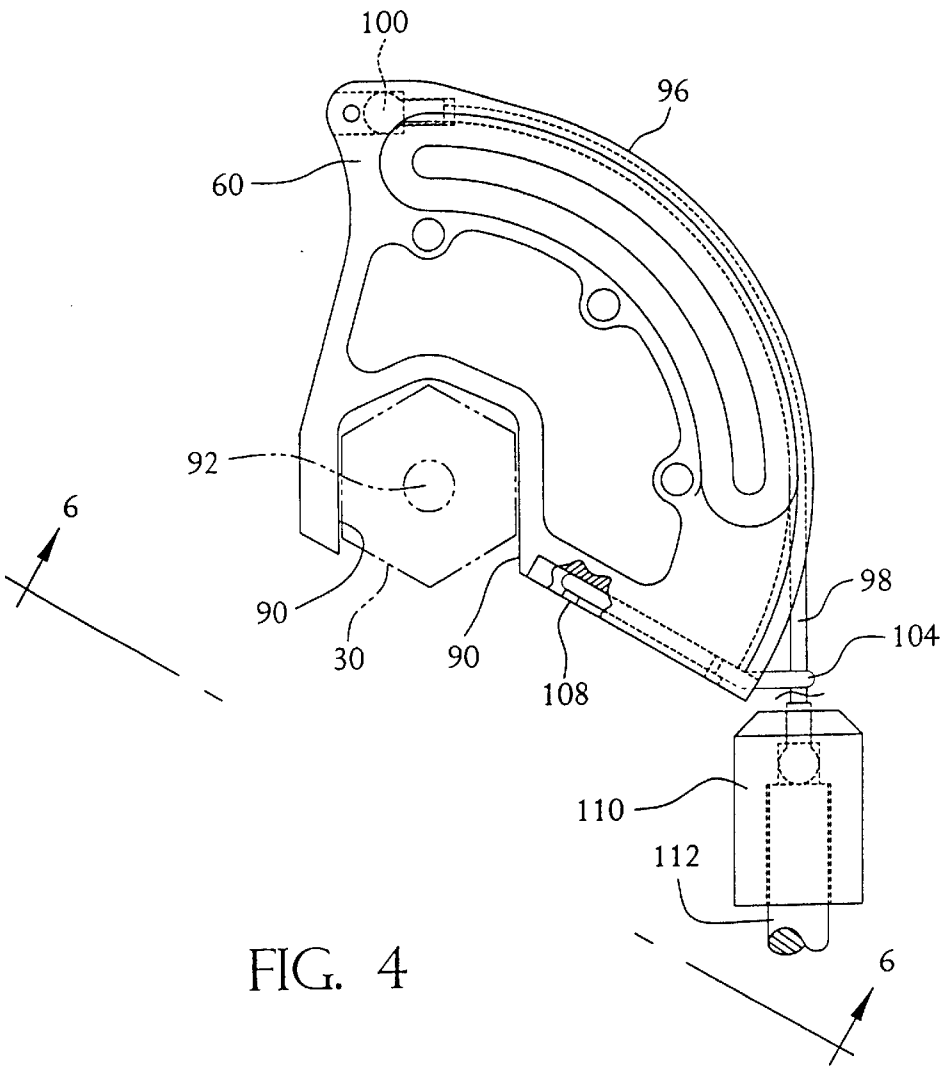
FIG. 4 is a side elevation of a wrench member for use within a screen stretching device.

In FIGS. 4–6 there is shown a wrench member 60 which forms a portion of each wrenching station. The wrench member 60 includes engagement surfaces 90 for engaging a nut-like end 30 of the rollers (illustrated in phantom in FIG. 4). The roller is rotated about its longitudinal axis 92 in the clockwise direction (as seen in FIG. 4) to increase tension in the screen material 94 (FIG. 1). The wrench member 60 forms an arcuate surface 96 having an axis which is coincidental with the longitudinal axis of the roller 92. As shown in phantom in FIG. 4, a cable 98 is attached at one end 100 to the top edge of the arcuate surface 96 and is positioned within a groove 102 (FIG. 5). Adjacent the lower edge of the wrench member 60, the cable 98 is secured by means of a resilient strap 104. The strap 104 is secured to a post 106 on the bottom surface of the wrench member 60 and wraps around the cable 98 at its opposite end. The post 106 includes an outwardly extending flange 108 over which the strap 104 is looped. The strap 104 maintains the cable 98 within the groove 102 in the arcuate surface 96.

An adaptor 110 is provided on the lower end of the cable 98. The adaptor 110 forms a releasable coupling between cable 98 and secondary cable 112 that connects to the wrench actuating means (discussed below). The end of the cable 98, positioned within the adaptor 110, may be removed so that the wrench member 60 can be removed and replaced as desired (FIG. 3). Various size rollers are manufactured and sold by today's roller frame manufacturers each of which include different size nut-like elements at their ends. Thus, multiple wrenches may be required. In addition, other configurations for a rotational driving member may be incorporated into the roller. The wrench may be replaced to accommodate these different devices.

Figure 7:
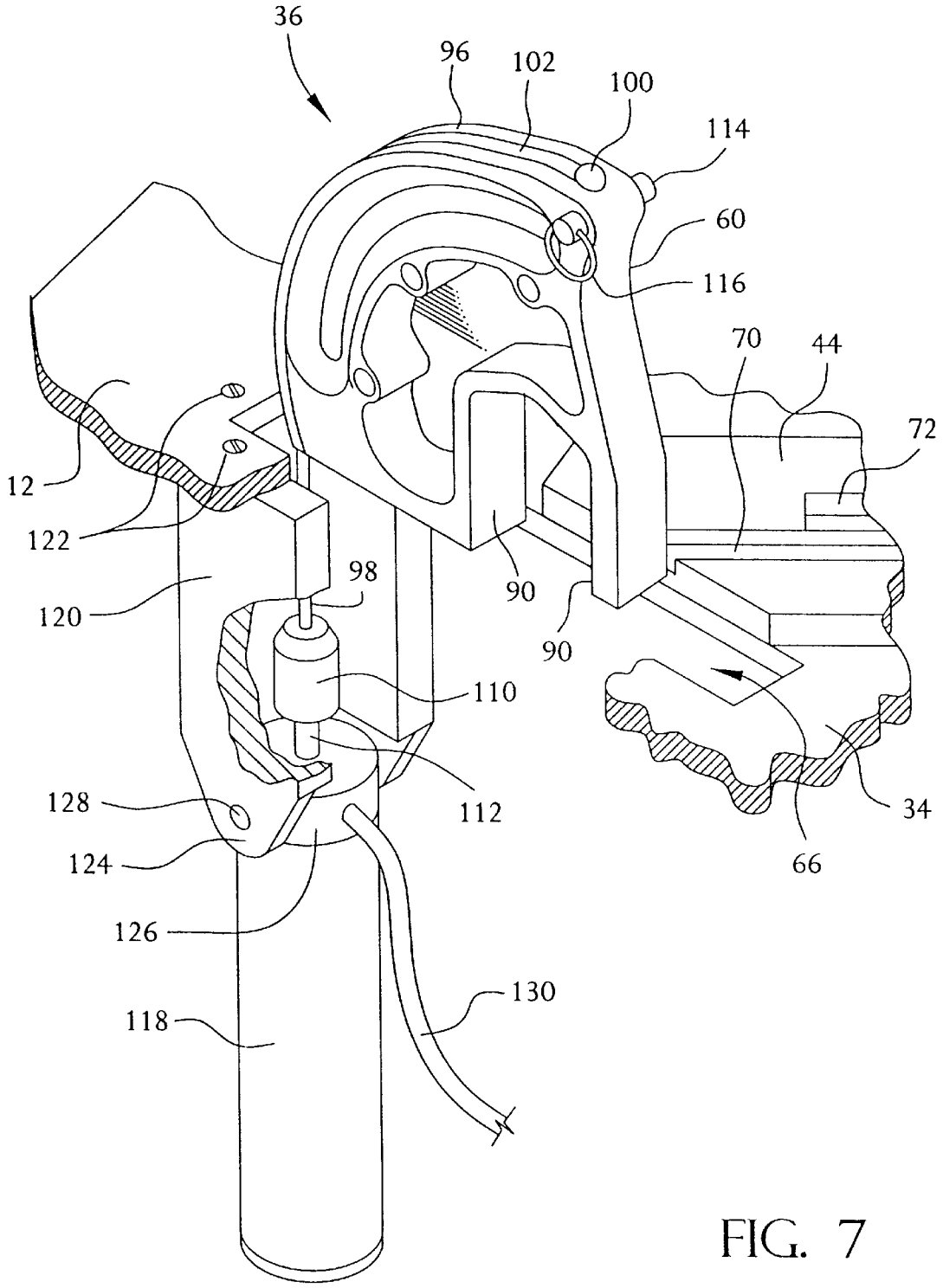
FIG. 7 is a perspective view of a fixed wrenching station within the screen stretching device of the present invention.

In FIG. 7 there is shown the first wrenching station 36 as it is positioned on the deck 12 of the device 10 on one side of the fixed pad 44. The second wrenching station (not shown in FIG. 7) is positioned on the opposite side of the fixed pad 44. The opening 66 in the deck 12 defines a passage for the wrench member 60. The wrench member 60 in each of the wrenching stations is floating in that it is not fixably secured to the surface of the deck or pivoted thereon. A pin 114 is positioned within a hole in the upper end of the wrench member 60. The pin 114 extends through the wrench member 60 and is long enough to prevent the wrench from falling through the opening 66 when not in use. A ring 116 is provided on one end of the pin 114 so that it may be easily removed.

As discussed with respect to FIGS. 4–6, one end 100 of the cable 98 is secured to the wrench member 60 and wraps around the arcuate surface 96 within groove 102. The cable 98 extends below the deck 12 and is attached to the adaptor 110. Below the adaptor 110 is a second cable part 112 which is attached to a pneumatic cylinder 118. The cylinder 118 is the actuating means which retracts the secondary cable 112 to cause rotation of the wrench member 60 about its engagement 90 with the roller.

The cylinder 118 is secured to a stanchion 120. In the first wrenching station, the stanchion 120 is fixed to the deck 12 by means of screws 122. The stanchion 120 forms a U-shaped channel through which the cable 98 and secondary cable 112 extend. The cylinder 118 is mounted on a cylinder mount 126 which is pivotably attached to the lower end of the stanchion 124 by pins 128. A bearing may be provided for the pins 128 so that the cylinder 118 may pivot. A tube 130 connects the cylinder 118 to a pneumatic source (not shown). Controls 58 for the pneumatic operation are shown in FIGS. 1–3.

The cylinder 118 is mounted by a pivot pin 28 such that any misalignment of the wrench 60 with respect to the cylinder is compensated for by the pivoting action with respect to the fixed stanchion 120. This assembly creates a wrenching means that rotates the rollers with a constant force, and creates a uniform torque and torsion in the rollers.

Figure 8:
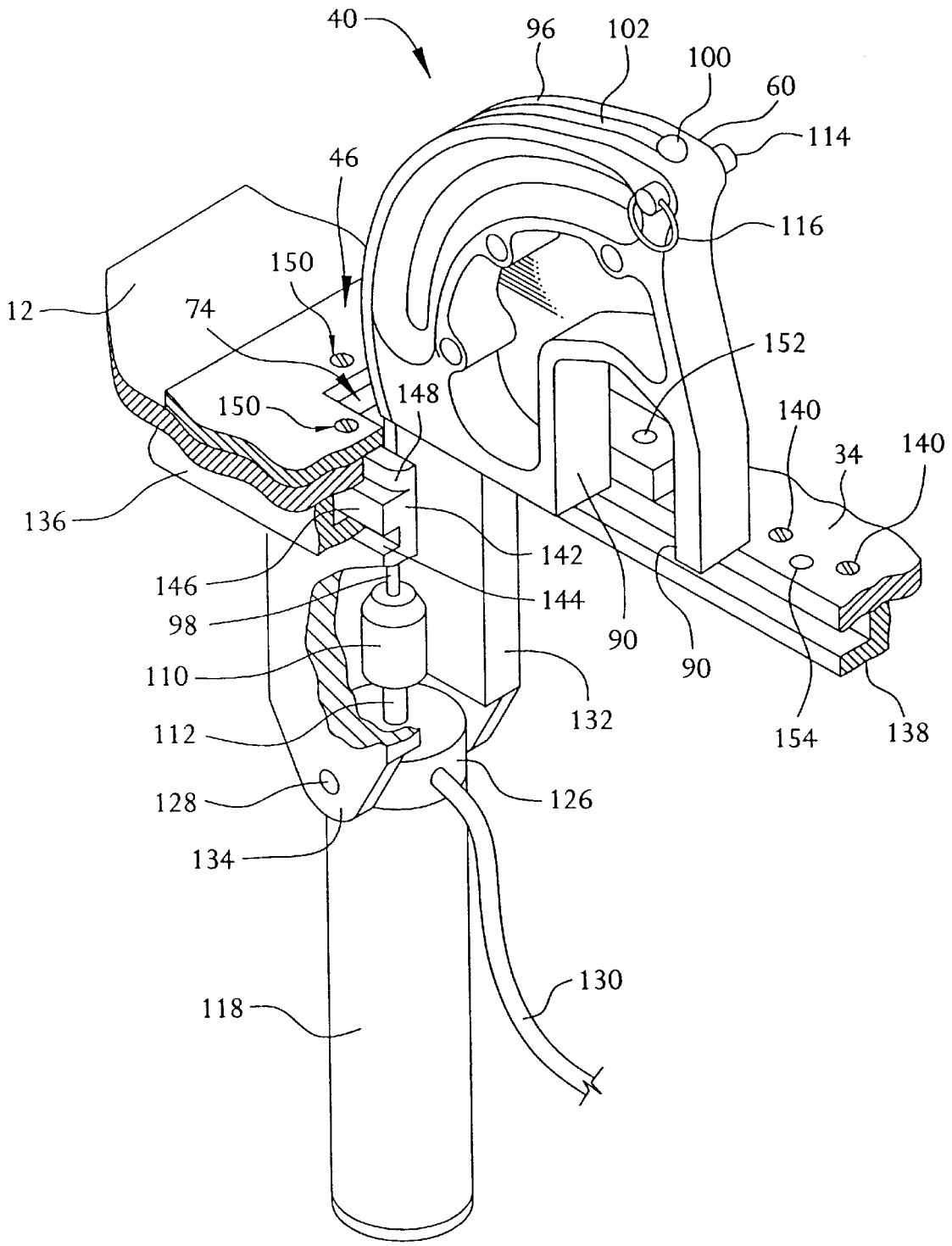
FIG. 8 is a perspective view of a movable wrenching station within the screen stretching device of the present invention.
Figure 9:
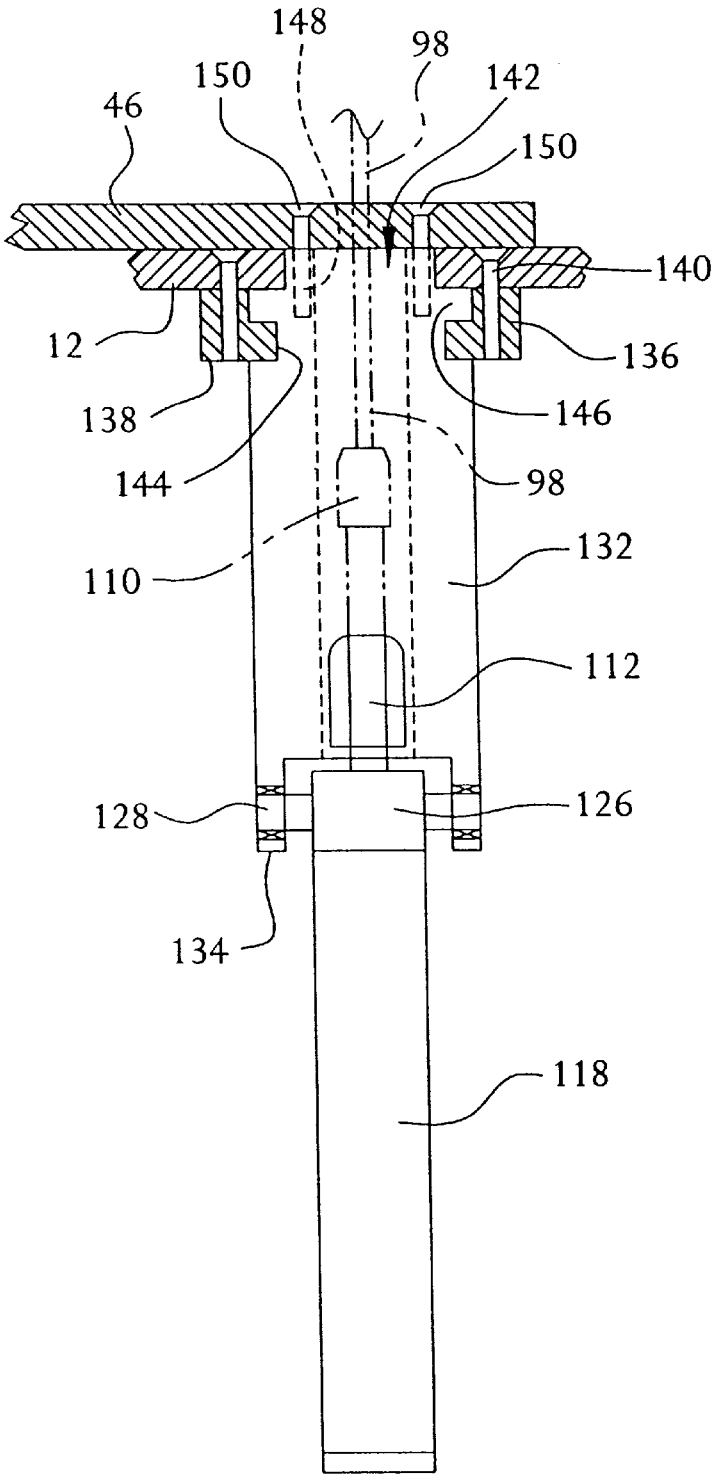
FIG. 9 is a rear side elevation of a movable wrenching station within the screen stretching device of the present invention.

FIGS. 8 and 9 illustrate the movable third wrenching station 40. It should be understood that the fourth wrenching station is substantially identical to that shown in FIGS. 8 and 9, the only difference being the movable pad is of a mirror image. The movable wrenching station 40 includes a wrench member 60 attached at its upper end 100 to a cable 98 which passes around the arcuate surface 96 within slot 102. A pin 114 is provided to position the wrench member 60 within the opening 74 when the wrench 60 is not in use. Below the surface of deck 12 is a movable stanchion 132. The movable stanchion 132 has a U-shaped channel within which the cable 98 and secondary cable 112 are positioned.

A pneumatic cylinder 118 is provided at the lower end 134 of the movable stanchion 132. A cylinder mount 126 is pivotably secured within the lower end 134 of the stanchion 132 my means of pins 128. A tube 130 for the pneumatic cylinder 118 connects the cylinder to the pneumatic source (not shown). Preferably, the first wrenching station 36 (FIG. 7) and the third wrenching station 40 are connected to the same pneumatic source and are concurrently controlled so that the tensioning force applied to the screen printing frame 94 (FIG. 1) is uniform in the direction between the two opposing rollers. The operation of a wrenching station has been described above as utilizing a pneumatic cylinder. Other actuating means are contemplated. For example, the pneumatic cylinder may be replaced by a hydraulic cylinder. Electric motors may also be utilized, including stepper motors and the like.

The movable stanchion 132 is supported below the deck 12 by means of rails 136 and 138. The rails 136, 138 are secured to the deck by screws 140. The upper end 142 of movable stanchion 132 includes a slot 144 and a projection 146 which are engaged within the grooves formed by the rails 136, 138. An upper projection 148 extends into the opening 74 in the deck 12 and is secured to the movable pad 46 by means of screws 150. The tolerances between combined pad 46 and stanchion 132 and the combined plate 12 and rails 136, 138 is such that the stanchion may be moved across the surface of the deck 12 to adjust the size of the work area 34 without significant displacement of parts upon torquing the roller. It is contemplated that the separation between movable parts within the movable wrenching station is in the range of 0.005 inches. A liquid or semi-liquid lubricant would not normally be used since it may have an effect on the screen material and cause damage to the stencil image. A series of Teflon (trademark) buttons may be provided on the underside of the sliding plate. These buttons may be mounted within counterbore holes on the bottom surface of the movable pad and contact the top of the deck plate.

Pin holes 152 are provided on the sliding plate 146 and match up with holes 154 in the deck 12. A pin (not shown, but similar to pin 114) is inserted into the hole 152 and a corresponding hole 154 in the deck so as to fix the position of the movable pad 46. When adjustment is desired, the pin may be removed and the pad (and stanchion) may be slid up and down the opening 74 within the deck 12. A similar type adjustment is used for sliding pad 50 at the "open" end of the roller frame (see FIG. 3).

As illustrated in FIGS. 8 and 9, the movable wrenching station 40 includes a stanchion 132 and movable pad 46. The rails 136, 138 provide a guide for the upper end of the movable stanchion 142. However, the rails may be omitted if desired. The rails in the present embodiment are contemplated to assist in stiffening the deck 12 so as to minimize distortion of the work area during tensioning. It has been found that the rails may be utilized to minimize localized defection in the deck plate 12 and are an alternative to using a heavier deck material.

Figure 10:
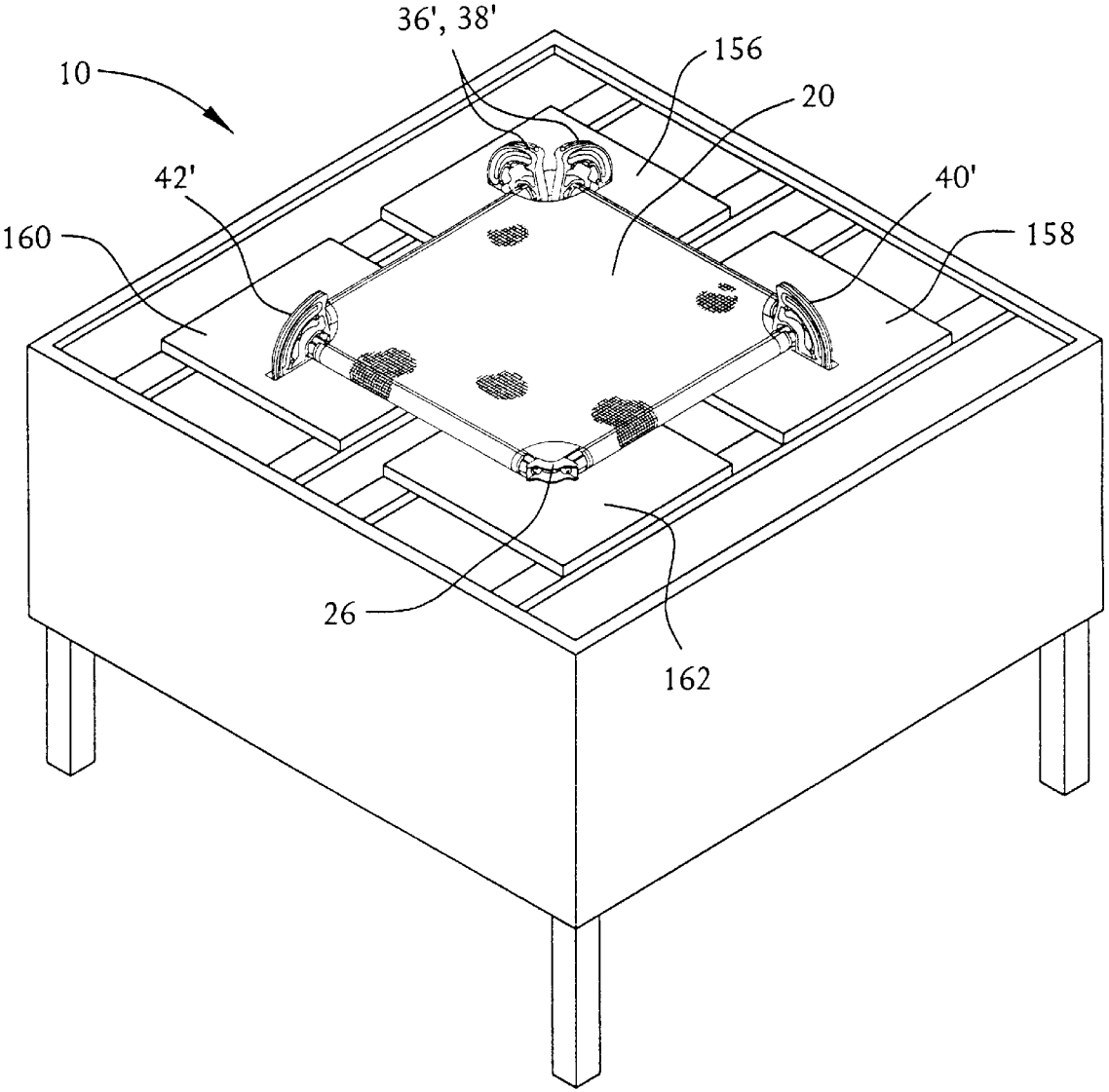
FIG. 10 is a perspective view of an alternate embodiment of the screen stretching device as contemplated by the present invention.

In FIG. 10 there is shown an alternate embodiment of the table 10'. In this embodiment, the first and second wrenching stations 36' and 38' are positioned on a plate 156 which is secured to the framing of the table. The third wrenching station 40' is positioned on a separate movable plate 158. The fourth wrenching station 42' is also positioned on a separate plate 160. The free corner 46 of the roller frame 20 does not have a wrenching station adjacent thereto. A plate 162 is provided for supporting the "open" corner 26 of the frame 20. Although not illustrated, a series of pads may be included on the plates to support the corner members of the roller frame.

As in the prior embodiment, the first wrenching station 36' is positioned opposite of the third wrenching station 40' and the second wrenching station 38' is positioned opposite of the fourth wrenching station 42'. Essentially, each of the stations is fixed to the plate upon which it is positioned. The plates are movable with respect to one another so as to adjust to the size of the work area to the size of the roller frame 20. The operation of the multiple plates 156, 158, 160 and 162 is contemplated to be similar to the apparatus previously sold under the "Newman Roller Master" trademark by Stretch Devices, Inc. of Philadelphia, Pa. However, the positioning and operation of the wrenching stations 36', 38', 40' and 42' is contemplated to be the same as that shown in the other embodiment herein.

The improvement of the present invention over stretching device shown in U.S. Pat. No. 5,488,901 and as previously sold relates to the form and position of the wrenching stations. It is desirable to stretch the screen on a roller frame such that the frame remains flat. Flatness of the frame is considered critical in screen printing operations to create consistency in color application, etc. In addition, the relative position of the wrenching stations balances the torsion in the rollers. Differences in the length of the sides of the frame and the thickness of the rollers may have a significant effect on maintaining the frame both square and flat. The factor which complicates this issue is the tension in the screen. Usually, screen tensions are in the rage of 30 newtons for a typical operation. However, frames are now often tensioned to 70 newtons and above. The advantages obtained by the higher screen tension are somewhat discounted if the frame is not square after tensioning and the corners are not flat. The higher the tension, the more important it is to balance the frame.

As discussed above, preferably the first and third wrenching stations and the second and fourth wrenching stations, respectively, are positioned opposite one another on the same end of the opposing parallel rollers in the roller frame. In addition, the cylinders in these respective wrenching stations are attached to a common regulator. This arrangement creates a balanced torque within the opposing rollers. Also, by providing a wrench that applies a constant torque to the rollers, the stretching of the screen printing fabric can be more precisely controlled.

The present invention may be embodied in other specific forms without departing from the spirit or essential attributes thereof and, accordingly, reference should be made to the appended claims, rather than to the foregoing specification, as indicating the scope of the invention.

We claim:

1. A device for stretching a screen secured to a rectangular roller frame having four sides joined to one another at four corners, at least three of the sides of the frame having an elongated cylindrical roller, an end portion, and a locking mechanism for controlling the rotational position of the roller, the device comprising:

a work area for receiving and supporting a roller frame, first, second and third wrenching stations, each wrenching station located at a corner of the work area, a wrench member provided in each wrenching station, each wrench member shaped and dimensioned to mate with an end portion of the rollers in a roller frame so that the wrench member may cause rotation of the roller, the first and second wrenching stations positioned adjacent one another at one corner of the work area, the first and second wrench members each positioned for causing rotation of one of the rollers positioned at one corner of the roller frame, the third wrenching station positioned opposite of the first wrenching station for rotating the opposing parallel roller of the roller frame, the wrench member for the first and third wrenching stations positioned to rotate the opposing rollers at the corresponding ends thereof, and means for actuating the first, second, and third wrenching members such that each wrench member rotates and torques the respective rollers, stretching the screen on the roller frame.

2. The device of claim 1 further comprising a fourth wrenching station having a wrench member shaped and dimensioned to mate with the end portion of a roller on the fourth side of the frame, the fourth wrenching station positioned opposite of the second wrenching station for rotation of the opposing parallel roller in the roller frame, the wrench member for the second and fourth wrenching stations positioned to rotate the opposing rollers at the same relative ends thereof.

3. The device as claimed in claim 2 further comprising a series of support pads for supporting the four corners of the roller frame on the rectangular work area.

4. The device as claimed in claim 2 wherein the third and fourth wrenching stations are each movable relative to the first and second wrenching stations, respectively, so that the device may adjust to accommodate different size roller frames.

5. The device as claimed in claim 2 wherein each actuation means applies a constant force to the wrench member for rotating and torquing the roller to which the wrench member is mated.

6. The device as claimed in claim 5 wherein the actuation means is connected to the wrench member by a flexible cable.

7. The device as claimed in claim 2 wherein the actuating means is selected from the group consisting of a hydraulic cylinder, a pneumatic cylinder and an electric motor.

8. The device as claimed in claim 1 wherein each actuating means applies a constant force to the wrench member for rotating and torque the roller to which the wrench member is mated.

9. The device as claimed in claim 1 wherein the third wrenching station is movable relative to the first and second wrenching stations so that the device can accommodate different size roller frames.

10. The device as claimed in claim 1 further comprising a series a support pads for supporting the corners of the roller frame on the work area.

11. The device as claimed in claim 1 wherein each wrench member further comprises:

a roller engagement surface for engaging the end of a roller and for applying a rotational force thereto about the longitudinal axis of the roller, and an arcuate application surface, the arcuate surface positioned outward of the roller engagement surface and forming a circular arc having an axis substantially coincidental with the longitudinal axis of the roller engaged by the engagement surface, and wherein each wrenching station further comprises a cable connected at one end to the wrench member and at the opposite end to the actuating means, the cable wrapped from the one end around the arcuate surface of the wrench member, the actuating means tensioning the cable and applying a tangential force to the arcuate surface of the wrench member and causing the wrench member to rotate the roller about their coincidental axes, torquing the roller with a constant force, and creating tension in the screen by the rotation of the roller.

12. A device for stretching a screen on a roller frame, the roller frame having four sides, each of the sides of the frame formed by a cylindrical roller, the rollers rotatably mounted at each end to a corner member, each of the rollers having means thereon for securing a side edge of the screen material to the roller, at least one end of each roller having a nut-like engagement surface, and the ends of the rollers having a locking mechanism for releasably fixing the rotational position of the roller, the device comprising:

first, second, third and fourth wrenching stations, each wrenching station located at a corner of a work area for the roller frame;

each of the wrenching stations including a floating wrench member comprising a roller engagement surface for engaging the end of the roller and for causing rotation of the roller about its longitudinal axis, and an arcuate application surface, the arcuate surface forming a circular arc having an axis coincident with the longitudinal axis of the roller, a cable connected at one end to the wrench member and wrapped around the arcuate surface; and means for actuating each of the first, second, third and fourth wrenching stations to rotate and torque the respective rollers and for stretching the screen on the roller frame, a second end of the cable operatively attached to the actuation means corresponding to the wrench member, upon actuation the actuation means tensioning the cable and causing the wrench member to rotate the roller and wrench member about their coincidental axes, torquing the roller with a constant tangential force, and creating tension in the screen by the rotation of the roller, the first and second wrenching stations positioned adjacent one another at one corner of the roller frame and the corresponding wrench member for causing rotation of one of the rollers attached to the corner, the third wrenching station positioned opposite of the first wrenching station for rotation of the opposing parallel roller in the roller frame, the wrench member for the first and third wrenching stations positioned to torque and rotate the opposing rollers at the relative same ends thereof, the fourth wrenching station positioned opposite of the second wrenching station for rotation of the opposing parallel roller in the roller frame, the wrench member for the second and fourth wrenching stations positioned to torque and rotate the opposing rollers at the relative same ends thereof, and the third and fourth wrench stations movable relative to the first and second wrench stations, respectively, so that the device may adjust to accommodate different size roller frames.

13. A device for stretching a screen secured to a rectangular roller frame having four sides, each side of the roller frame having a cylindrical roller, four corner members attached to the ends of the rollers to form the frame, means for securing the screen along the length of each roller, each roller having means thereon for rotating the roller about its longitudinal axis, and a locking mechanism for fixing the rotational position of the roller, the device comprising:

a table member having a top surface and a work area defined on the top surface for supporting the roller frame while the screen is being stretched;

first, second, third and fourth wrenching stations, each wrenching station including a floating wrench member adapted to engage the rotating means on a roller, each wrenching station having means for causing rotation of the corresponding wrench member about its engagement with the roller and rotation of the roller about its longitudinal axis and the rotation means creating a constant force for torquing the roller and tensioning the screen on the roller frame, the first and second wrenching stations positioned adjacent one another at one corner of the roller frame and for causing rotation of one of the respective rollers attached to the corner, the third wrenching station positioned directly opposite of the first wrenching station for rotation of the opposing roller in the roller frame, the first and third wrenching stations positioned to rotate the opposing rollers from the same relative ends thereof, and the fourth wrenching station positioned directly opposite of the second wrenching station for rotation of the opposing roller in the roller frame, the second and fourth wrenching stations positioned to rotate the opposing rollers from the same relative ends thereof.

14. In a device for stretching a screen on a roller frame, the roller frame having four sides, each of the sides of the frame formed by a cylindrical roller, the rollers rotatably mounted at each end to a corner member, each of the rollers having means thereon for securing a side edge of the screen material to the roller, at least one end of each roller having a nut-like engagement surface, and the ends of the rollers having a locking mechanism for releasably fixing the rotational position of the roller, the device including a series of wrenching stations for engaging the nut-like ends of the rollers and for causing rotation of the rollers, the wrenching stations each comprising:

a floating wrench head, the wrench head having engagement surfaces for engaging opposite parallel surfaces of the nut-like end of a roller, wrench head having an arcuate application surface, the arcuate surface forming a circular arc having an axis coincidental with the longitudinal axis of the roller, and a cable connected at one end to the wrench head and wrapped around the arcuate surface, such that upon tensioning the cable and causing the wrench head to rotate the roller about the coincidental axes a constant tangential force is applied to the wrench head to torque the roller.

15. A method of stretching a screen on a rectangular roller frame having four sides and four corner members, each of at least three of the sides of the frame having a cylindrical roller, an end portion, and a locking mechanism for controlling the rotational freedom of the roller, the method comprising the steps of:

attaching a screen along substantially the entire length of each of the rollers on the roller frame;

attaching a wrench tool to an end portion of each roller, two of the wrench tools positioned adjacent one another at one corner of the frame each for causing rotation of one of the rollers attached to the corner, the third wrench tool positioned directly opposite of the first wrench tool for rotation of the opposing roller in the frame, the first and third wrench tools positioned to rotate the opposing rollers at the relative same ends thereof;

rotating and torquing all of the wrench tools substantially simultaneously so that the screen is evenly stretched over the frame; and activating the locking mechanisms so that the rollers are prevented from rotating and the stretched state of the screen is maintained by the frame.

* * * * *

UNITED STATES PATENT AND TRADEMARK OFFICE

CERTIFICATE OF CORRECTION

PATENT NO. : 5,937,753

DATED : August 17, 1999

INVENTOR(S) : Thomas A. McKeever, et al.

It is certified that error appears in the above-identified patent and that said Letters Patent is hereby corrected as shown below:

On the title page, item [19], change "McKeever" to --McKeever, et al.--, and item [75], change "Inventor" to -- Inventors --, after "Thomas A. McKeever, Maple Shade, N.J." add -- Don Newman, Wyncote, P.A. --.

Signed and Sealed this

Ninth Day of May, 2000

*Attest:*

Q. TODD DICKINSON

*Attesting Officer*

*Director of Patents and Trademarks*